US006033147A

United States Patent [19]

Richter

[11] Patent Number: 6,033,147

[45] Date of Patent: Mar. 7, 2000

[54] METHOD FOR PRODUCING A TWO-LAYER ASPHALTIC SURFACING

[76] Inventor: Elk Richter, Alte Dorfstrasse 11, 38321 Dorstadt, Germany

[21] Appl. No.: 08/656,255

[22] PCT Filed: Nov. 23, 1994

[86] PCT No.: PCT/DE94/01404

§ 371 Date: Jul. 22, 1996

§ 102(e) Date: Jul. 22, 1996

[87] PCT Pub. No.: WO95/14819

PCT Pub. Date: Jun. 1, 1995

Related U.S. Application Data

[63] Continuation of application No. 08/656,255, Jul. 22, 1996, abandoned.

[30] Foreign Application Priority Data

Nov. 27, 1993 [DE] Germany ..... 43 40 421
Dec. 16, 1993 [DE] Germany ..... 43 42 999

[51] Int. Cl.[7] ..... E01C 7/22

[52] U.S. Cl. ..... 404/79; 404/80; 404/82

[58] Field of Search ..... 404/72, 75, 77, 404/79, 82, 27, 17, 31, 80, 81; 427/136, 138, 139

[56] References Cited

U.S. PATENT DOCUMENTS

| | | | |
|---|---|---|---|
| 2,220,149 | 11/1940 | Finley | 404/82 |
| 3,707,901 | 1/1973 | Bynum, Jr. et al. | 404/82 X |
| 4,066,723 | 1/1978 | King et al. | 404/82 X |
| 4,534,674 | 8/1985 | Cutler | 404/82 X |
| 4,594,022 | 6/1986 | Jeppson | 404/79 X |
| 4,708,516 | 11/1987 | Miller | 404/82 X |
| 4,784,518 | 11/1988 | Cutler | 404/82 X |
| 4,974,993 | 12/1990 | Crabbi | 404/79 |
| 5,069,578 | 12/1991 | Bense et al. | 404/75 |
| 5,851,085 | 12/1998 | Campbell | 404/75 |

FOREIGN PATENT DOCUMENTS

| | | | |
|---|---|---|---|
| 2697036 | 4/1994 | France . | |
| 62-21081 | 5/1987 | Japan | 404/82 |
| 372267 | 10/1930 | United Kingdom . | |

*Primary Examiner*—James A. Lisehora
*Attorney, Agent, or Firm*—Horst M. Kasper

[57] ABSTRACT

Top layers of asphalt surfacing are laid in hot laying method in one work cycle. A first layer of a first asphalt production type hot is placed on a surface to be covered. Simultaneously with the first layer is placed a second layer of a second asphalt production type different from the first production type hot on top of the first layer. Owing to the simultaneous laying of two different and hot on hot asphalt layers from delivered mixture from an asphalt plant, thermal potential is increased and cooling delayed, therefore a considerable improvement in properties of theses two asphalt layers is achieved.

16 Claims, 2 Drawing Sheets

METHOD FOR PRODUCING A TWO-LAYER ASPHALTIC SURFACING

This application is an International 371 of PCT/DE94/01404 filed Nov. 23, 1994 and a continuation, of application number 08/656,255 filed May 28, 1996, now abandoned.

BACKGROUND OF THE INVENTION

1. Field of the Invention

The invention concerns a method for producing a two-layer asphaltic surfacing with which an optimisation of the properties of the asphalt layers is effected.

2. Brief Description of the Background of the Invention Including Prior Art

As set forth by the methods known in the state of the art, multi-layer asphalt surfacings are produced using different types of asphaltic mixtures. The mixture is laid in courses or—if the same mixtures are worked—in layers on top of one another. To bond the layers, asphaltic emulsions are spread on the cold supporting medium.

Asphalt surfacings are used on roads as well as for other traffic surfaces. The total thickness of the structure and of the individual layers depends primarily on the prevailing loads. Generally, asphalt surfacings consist of surface, binder, and base courses. Individual courses must fulfil different requirements. For the surface course, primarily the following requirements are important:

- for traffic safety reasons good grip, even surface, luminosity, and the highest possible reflectivity are important;
- to guarantee high weather resistance sealing, frost resistance, volume stability, adhesion of the binder, and oxidation stability are required and
- to ensure sufficient strength flexibility, stability and wear resistance, as well as fatigue strength requirements must be fulfilled.

Today, with the loads from heavy traffic, the binder course has the primary task of absorbing the shear stress without damage and diverting it. For this reason, stability must take priority in binder courses.

The asphalt base course serves to absorb, without damage, and divert the stresses occurring in the overlying areas. They must also be structured so as to be stable.

Binder and base course are protected by the surface course and therefore do not have any sealing tasks.

Generally, the surface courses are laid to a thickness of 4 cm. The nominal thicknesses of the binder and asphalt base courses vary depending on the building regulations applying to the construction class, such as RStO 86/89. Arand et al.: Investigation of the Efficiency of High Performance Compaction Beams Through Field Measurements on Rolling Construction Sites, Road and Motorways, Bonn 41 (1990) No. 5, pp. 215–219.

The evolution of asphalt road construction in the last decades was characterised by optimisation of the individual layers as regards composition, course thickness, and compaction, in order to meet the continuously growing loads from the growth in traffic load figures and the rise in axle loads. The influence of the axle loads upon working behaviour is generally determined pursuant to the results of the AASHO ROAD Test. This stipulates that fatigue and deformation damage increase approximately by the power of four of the axle load.

Specifically increasing axle loads as well as overloading and growth in heavy traffic through the continual increase in transport movement on roads has lead to an increase in the frequency of damage. Moreover, the evolution of road construction technology mostly lags behind the evolution of requirements. Involved in the damage caused by deformation are the surface, and partially also the binder, through to the base courses. The causes lie above all in material composition and compaction. The surface courses represent a special problem, especially since the multiplicity of tasks demand quite different conceptional decisions. For example, sealing and stability operate in a contradictory manner.

As a consequence of its sealing function, the surface course is the course richest in binder, which at the same time is subject to the highest possible temperatures. Owing to the thermoplastic properties of the bitumen, the surface course material has the lowest shear strength in summer.

A further problem, which is of immense importance for asphalt road construction, is laying asphalt under unfavourable laying conditions. This results in, in the case of the surface and binder courses of 4 cm layer thickness that frequently have to be laid, too little compaction time and too rapid cooling of the asphaltic mixture. Whilst having the same compaction expenditure vis-a-vis thicker laid thicknesses, lower degrees of compaction are achieved at lower thicknesses as a result of faster cooling.

In the state of the art it is known to improve the compactability by increasing the binder content. However, this reduces the shear strength. Generally, a lower degree of the compaction involves an exponential reduction in, for example, stability. The laying of single course of asphalt common in the state of the art, in which the next course is laid upon a cold or to a large extent already cooled supporting medium, results in constraints as well as quality deficiencies specifically in the case of these relatively thin surface and binder courses.

It is known, in the rehabilitation of asphaltic surfacings, to create two-layer asphaltic surfacings by heating the existing, mostly damaged asphalt and distributing it on the job site or mixing it with other asphalt components. Owing to the relatively low thermal conductivity of the asphalt, the bitumen is subject to widely differing temperatures during heating.

On the top side of the asphalt layer temperatures of 250–600° C. occur which decrease sharply downwards. These high temperatures lead to greater environmentally harmful emissions as well as to changes in the properties of the bitumen.

Furthermore, the quality of the distributed or mixed components on the road is subject to large fluctuations compared with asphalt produced by the mixing process at an asphalt mix plant, since the ratio of old and new components is to be less adhered to and the contract section often contains different compositions.

SUMMARY OF THE INVENTION

1. Purposes of the Invention

The object of the invention is to specify a method for producing a two-layer asphaltic surfacing from two ready-to-deliver types of mixture, with which the total laying thicknesses are significantly increased and the course thickness ratio, the composition and thus properties are optimised. Optimisation concerns especially the degree of compaction without increasing the compacting energy.

These and other objects and advantages of the present invention will become evident from the description which follows.

2. Brief Description of the Invention

In accordance with the invention this object is solved successfully therein that the top layers of the asphalt surfacing are laid in hot laying method in one work cycle and the layer thickness ratio to one another is changed.

Owing to the simultaneous laying of two different and hot on hot superimposed asphalt layers from delivered mixture from the asphalt plant, the thermal potential is increased and cooling delayed, therefore allowing a considerable improvement in the properties of these two asphalt layers.

This concerns the simultaneous laying of asphalt binder plus surface course as well as in the case of less well frequented roads asphalt base plus surface course as well as the combination of asphalt base course and asphalt binder.

Furthermore by means of direct hot-on-hot laying an optimum adhesion of layers is achieved. The deformation behaviour associated with lateral yielding (slippage) is thus improved. Simultaneous two-layer laying permits modification of the asphalt formulas toward more stable mixtures, since the level of compaction degree in both asphalt layers is significantly increased and thus at the same time the voids content can be reduced. Economic advantages are given by the reduction of the expensive surface course material. In addition, improved binders and/or polishing resistant chippings can be used. A high compaction is only achieved with sufficient laying thicknesses. Generally, in the case of the traditional construction method, this requires a ratio of course thickness to top size aggregate of approx. 3:1. This yields, for example, a laying thickness of 4 cm for asphaltic concrete 0/11 mm.

Normally, lower course thicknesses are sufficient to fulfil the sealing function. For reasons of compactability on the cold asphalt supporting medium, one is forced to adapt the laying thickness of the binder rich and thus less shear resistant surface course to the compactability. Deriving from the loads, this yields an increased tendency to deformation.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
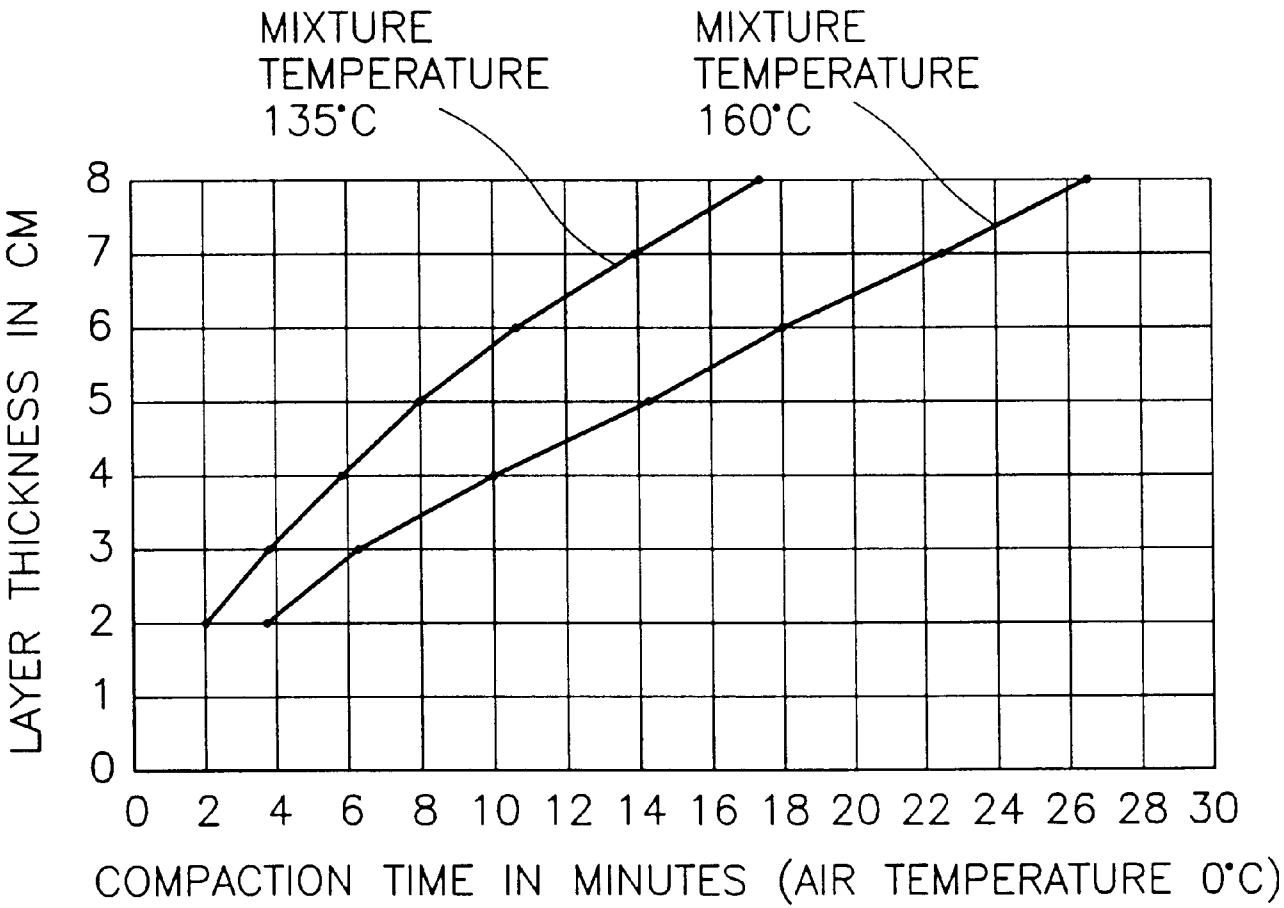
FIG. 1 shows a representation of the dependency of compaction time upon the course thickness.
Figure 2:
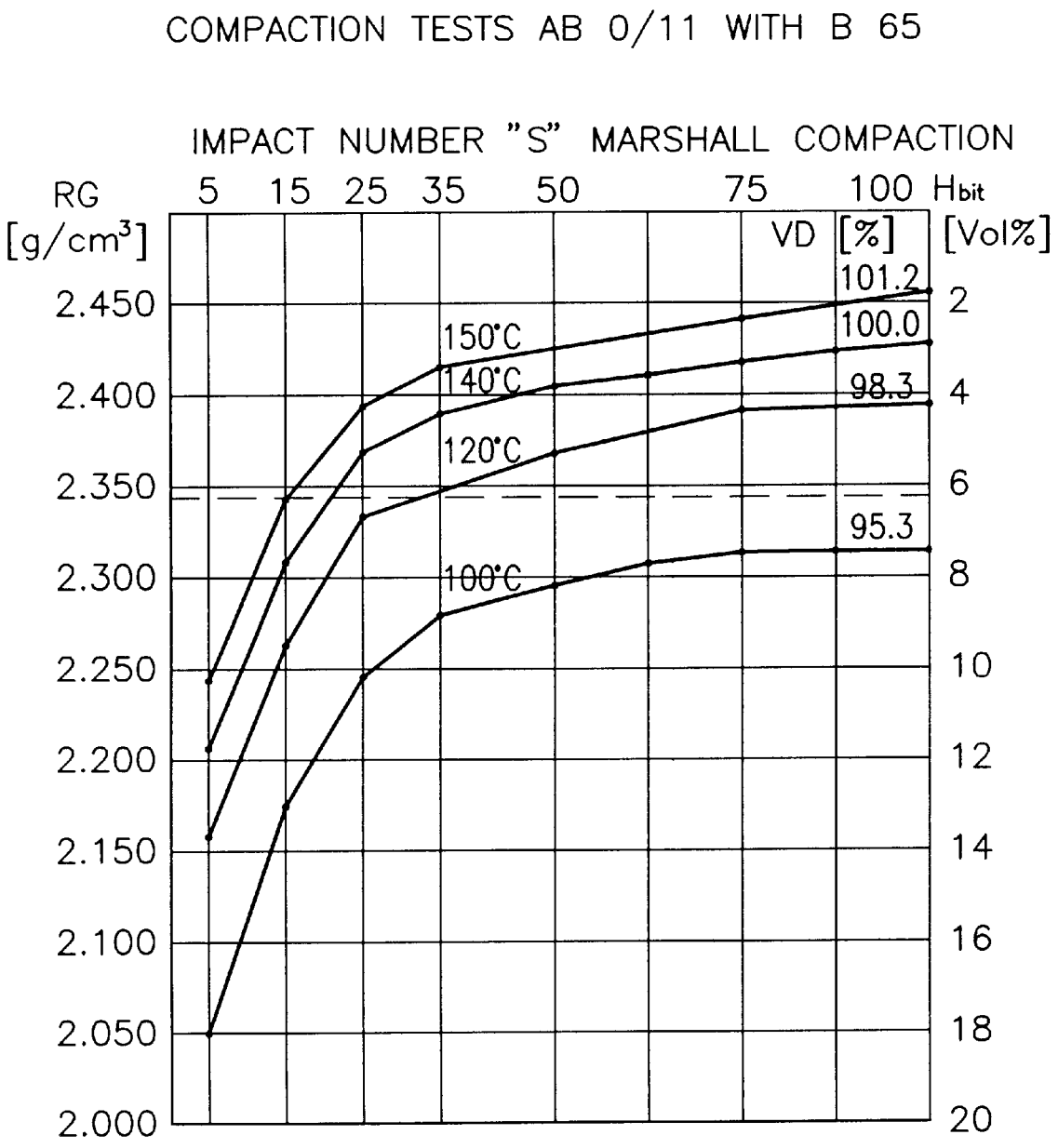
FIG. 2 shows the influence of the mixture temperature upon the volume density (RG) and the compaction degree (VD).

In the first example, 10 cm of asphalt base course type CS 0/32 mm and simultaneously 4 cm of asphalt binder 0/16 mm are laid. Owing to the total layer thickness of 14 cm compared with 10 cm of asphalt base course and 4 cm asphalt binder, the compaction time is considerably extended and the level of degree of compaction of both layers is increased. This leads to a significant increase in deformation resistance in both layers and there are no material losses of the asphalt binder, as often determinable in the usual state of the art laying of hot on cold.

In a second example, 10 cm of asphalt binder 0/22 mm and simultaneously 2 cm of chipping mastic asphalt 0/11 mm are laid. Owing to the total layer thickness of 12 cm hot asphalt compared with 8 cm of asphalt binder and 4 cm surface course, compaction time is considerably extended and the level of the degree of compaction of both layers is increased. The asphalt binder receives a greater compactness and is thus more resistant to deformation. Despite non-observance of the top size aggregate rule, the chipping mastic asphalt 0/11 mm is significantly more effective compared with 4 cm on a cold supporting medium. Owing to the replacement of 2 cm binder rich chipping mastic asphalt 0/11 mm by the deformation resistant asphalt binder 0/22 mm, the total surfacing becomes considerably more stable with retention of the other functions of the surface course.

In example 3, 6 cm of asphalt binder 0/16 mm and simultaneously 2 cm of asphaltic concrete 0/11 mm are laid. Owing to the total layer thickness of 8 cm hot asphalt compared with 4 cm of asphalt binder and 4 cm of asphaltic concrete, the compaction time is considerably extended and the level of compaction degree of both layers is increased. The asphalt binder obtains a greater compactness and is thus more resistant to deformation. Despite non-observance of the top size aggregate rule, the asphaltic concrete 0/11 mm was compacted in optimum manner and sufficiently dense. Owing to the replacement of 2 cm of binder rich asphaltic concrete 0/11 by the more deformation resistant asphalt binder 0/16, the total surfacing is considerably more stable whilst retaining the other functions of the surface course.

It will be understood that method described above may also find a useful application in other types of producing asphaltic surfacing differing from the types described above.

While the invention has been illustrated and described as embodied in the context of a method for producing a two-layer asphaltic surfacing, it is not intended to be limited to the details shown, since various modifications may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. Method for producing a two-layer asphaltic surfacing comprising:

laying a first type mixture hot in form of a first layer having a layer thickness of 10 centimeters and grains sized from about 0 to 32 mm;

laying a second type mixture hot in the form of a second layer at a certain distance behind a place where the first type mixture was laid as the first layer, wherein the laying the first type mixture and the laying the second type mixture are conducted concurrently;

compacting together the first type mixture and the second type mixture.

2. Method according to claim 1, wherein a layer thickness of a surface course forming the second layer is reduced and a layer thickness of a binder course forming the first layer is increased by the amount of reduction of the layer thickness of the surface course.

3. Method according to claim 1, wherein an binder course forming the second layer and a base course forming the first layer are laid together.

4. Method according to claim 1, wherein a surface course forming the second layer and a binder course forming the first layer are laid together.

5. Method according to claim 1, wherein a surface course forming the second layer and a base course forming the first layer are laid together.

6. Method according to claim 5, wherein a course thickness of the surface course is reduced by a first amount and that a course thickness of the base course is increased by the first amount.

7. A method for producing a two-layer asphaltic surfacing comprising the steps of:

placing a first layer of a first asphalt composition hot on a surface to be covered, placing a second layer of a second asphalt composition different from the first asphalt composition hot on top of the first layer while the first layer is still hot, wherein a layer thickness of the second layer is 4 centimeters, and wherein the second layer consists of grains sized from about 0 to 16 mm.

8. The method according to claim 7, wherein the layer thickness of the second layer is smaller as compared to the layer thickness of the first layer.

9. The method according to claim 7, wherein the first layer is a combination of an asphalt binder and an asphalt base laid together.

10. The method according to claim 7, wherein the second layer is a combination of an asphalt surface and of an asphalt binder laid together.

11. The method according to claim 7, wherein the first layer furnishing a surface course and the second layer furnishing a base course are deposited together.

12. The method according to claim 11, wherein the layer thickness of the second layer is smaller as compared to the layer thickness of the first layer.

13. A method for producing a two-layer asphaltic surfacing comprising the steps of:

placing a first layer of a first asphalt composition hot on a surface to be covered, placing a second layer of a second asphalt composition different from the first asphalt composition hot on top of the first layer while the first layer is still hot, wherein the layer thickness of the second layer is 4 centimeters and wherein the layer thickness of the first layer is 10 centimeters;

wherein the first layer is of an asphalt essentially consisting of grains sized from about 0 to 32 mm;

wherein the second layer is of an asphalt binder essentially consisting of grains sized from about 0 to 16 mm.

14. A method for producing a two-layer asphaltic surfacing comprising the steps of:

placing a first layer of a first asphalt composition hot on a surface to be covered, placing a second layer of a second asphalt composition different from the first asphalt composition hot on top of the first layer while the first layer is still hot, wherein the layer thickness of the second layer is 2 centimeters during laying and wherein the layer thickness of the first layer is 10 centimeters during laying and resulting in a 12-centimeter total thickness;

wherein the first layer is of an asphalt binder essentially consisting of grains sized from about 0 to 22 mm;

wherein the second layer is of a chipping mastic asphalt essentially consisting of grains sized from about 0 to 11 mm.

15. A method for producing a two-layer asphaltic surfacing comprising the steps of:

placing a first layer of a first asphalt composition hot on a surface to be covered, placing a second layer of a second asphalt composition different from the first asphalt composition hot on top of the first layer while the first layer is still hot, wherein the layer thickness of the second layer is 2 centimeters during laying and resulting in a 2-centimeter thickness, wherein the layer thickness of the first layer is 6 centimeters during laying and resulting in an 8 centimeter total thickness;

wherein the first layer is of an asphalt binder essentially consisting of grains sized from about 0 to 16 mm;

wherein the second layer is of a chipping mastic asphalt essentially consisting of grains sized from about 0 to 11 mm;

further comprising:

considerably extending the compaction time of the first layer and of the second layer as compared to a construction wherein the first layer is 4 centimeters of asphalt binder and wherein the second layer is 4 centimeters of asphaltic concrete.

16. Method for producing a two-layer asphaltic surfacing essentially consisting of:

laying a first type mixture hot in form of a first layer having a layer thickness of 10 centimeters and grains sized from about 0 to 32 mm;

laying a second type mixture hot in the form of a second layer at a certain distance behind a place where the first type mixture was laid as the first layer, wherein the laying of the first type mixture and the laying of the second type mixture are conducted concurrently;

compacting together the first type mixture and the second type mixture.

* * * * *